US008269155B2

(12) United States Patent
Welsh et al.

(10) Patent No.: US 8,269,155 B2
(45) Date of Patent: Sep. 18, 2012

(54) FOOD SERVICE HEAT RETENTION DEVICE

(75) Inventors: Thomas J. Welsh, Lombard, IL (US); Vangelis Economou, Wilmette, IL (US)

(73) Assignee: MEDport LLC, Providence, RI (US)

( * ) Notice: Subject to any disclaimer, the term of this patent is extended or adjusted under 35 U.S.C. 154(b) by 1379 days.

(21) Appl. No.: 11/801,521

(22) Filed: May 8, 2007

(65) Prior Publication Data

US 2008/0277400 A1 Nov. 13, 2008

(51) Int. Cl.

| | |
|---|---|
| ***H05B 6/64*** | (2006.01) |
| ***H05B 6/80*** | (2006.01) |
| ***H05B 6/12*** | (2006.01) |
| ***F24C 15/18*** | (2006.01) |
| ***F24H 7/00*** | (2006.01) |

(52) U.S. Cl. ..... 219/759; 219/730; 219/620; 219/621; 126/246; 126/375.1

(58) Field of Classification Search ..... 219/759, 219/730, 732, 620, 621, 432; 220/592.2; 126/246, 375.1

See application file for complete search history.

(56) References Cited

U.S. PATENT DOCUMENTS

| | | | | |
|---|---|---|---|---|
| 2,574,297 | A | 11/1951 | Smith | |
| 2,703,773 | A | 3/1955 | Stimson | |
| 3,148,676 | A * | 9/1964 | Truog et al. | 126/246 |
| 3,400,638 | A | 9/1968 | McEvoy | |
| 3,734,077 | A | 5/1973 | Murdough et al. | |
| 3,837,330 | A | 9/1974 | Lanigan et al. | |
| 4,134,535 | A | 1/1979 | Barthels et al. | |
| 4,143,787 | A | 3/1979 | Walker | |
| 4,258,695 | A | 3/1981 | McCarton et al. | |
| 4,567,877 | A | 2/1986 | Sepahpur | |
| 4,712,606 | A | 12/1987 | Menelly | |
| 4,911,401 | A | 3/1990 | Holcomb et al. | |
| 4,938,254 | A | 7/1990 | Gimby | |
| 4,989,419 | A | 2/1991 | Brando et al. | |
| 5,031,875 | A | 7/1991 | Zimmerman | |
| 5,052,369 | A | 10/1991 | Johnson | |
| 5,059,036 | A | 10/1991 | Richison et al. | |
| 5,107,087 | A | 4/1992 | Yamada et al. | |
| 5,263,777 | A | 11/1993 | Domke | |
| 5,520,103 | A * | 5/1996 | Zielinski et al. | 99/483 |
| 5,553,942 | A | 9/1996 | Domke et al. | |
| 6,005,233 | A | 12/1999 | Wyatt | |
| 6,188,053 | B1 | 2/2001 | Wyatt | |
| 6,210,824 | B1 | 4/2001 | Sullivan et al. | |
| 6,310,329 | B1 * | 10/2001 | Carter | 219/432 |

(Continued)

FOREIGN PATENT DOCUMENTS

| | | |
|---|---|---|
| WO | 2008140740 | 11/2008 |

*Primary Examiner* — Henry Yuen
*Assistant Examiner* — Hung D Nguyen

(57) ABSTRACT

A heat retaining dish includes a pressure relief mechanism and has a heat retention material capable of being heated by microwave or other thermal radiation in order to maintain any food placed on the dish at an elevated temperature. The heat retention material is capable of accommodating expansion during heating of the device, and when an overpressure condition occurs as a result of inadvertent overheating, the pressure relief mechanism vents the pressure to the ambient environment. The pressure relief mechanism is an integral part of the wall construction of at least one of the portions making up the housing of the device, and deformation due to overpressure directly causes the opening of the pressure relief mechanism as soon as the housing is deformed sufficiently to open a fluid communication path through an aperture in the wall.

11 Claims, 4 Drawing Sheets

U.S. PATENT DOCUMENTS

| | | | |
|---|---|---|---|
| 6,622,881 | B2 | 9/2003 | Hardigg |
| 6,662,827 | B1 | 12/2003 | Clougherty et al. |
| 6,802,929 | B2 | 10/2004 | Ruotsalainen |
| 7,038,179 | B2 | 5/2006 | Kim et al. |
| 7,082,973 | B2 | 8/2006 | Ganachaud et al. |
| 7,176,426 | B2 | 2/2007 | Ramirez |
| 7,183,525 | B2 | 2/2007 | Fuchs |

* cited by examiner

FOOD SERVICE HEAT RETENTION DEVICE

BACKGROUND OF THE INVENTION

1. Field of the Invention

This invention relates generally to a heat retention device for containers and more specifically to heat storage and retention devices capable of absorbing thermal or microwave energy, storing it as latent heat energy in a material disposed in a chamber of the device that is isolated from the food stuffs, thereby maintaining the temperature of the food stuffs at an elevated temperature.

2. Background Art

Keeping food warm after its preparation and prior to its consumption has long been a desirable goal of food preparers. Especially in more recent times, following the recognition that to be safe, food must be free of bacteria and other unhealthy contaminants, food is required to be kept in a temperature range of less than about 38° F. (for which occasion assignees of the present invention have developed a corresponding construction, see commonly owned U.S. Pat. No. 4,989,419) and above about 140° F., the subject of this invention. Special attention to this problem is required for foods served in restaurants, to patients in hospitals, and other instances when a relatively long period of time elapses between the food preparation and the time the food is served and consumed. Additionally, it is also desirable to maintain the temperature of food that requires delivery over long distances, for example, pizza or take out food.

Another instance in which food should be kept warm is when it has been prepared for self service, for example, on an appetizer tray. Here, as the food is consumed over a period of time by persons serving themselves, there is normally a lapse of time between the food being ready and its actual consumption.

Microwave ovens have become standard appliances in most kitchens and food preparation areas. They use electromagnetic radiation to heat, in most instances, water molecules contained within food stuffs, and so to cook foods or warm them up for serving. A microwave oven utilizes very short radio waves, the so called microwaves, which are also commonly employed in other standard uses, such as radar and satellite communications. When concentrated and focused into a small volume, microwaves can efficiently heat water and other substances contained in that volume, such as foods. Microwaves generally cook food rapidly and efficiently because, unlike conventional ovens, they only heat, for example, water contained in the food, and no need exists to heat the air or the oven walls. Heat energy then disperses within the food by conduction from the heated water molecules.

Microwaves can easily pass through many types of materials, including heat insulating materials, for example, glass, paper, ceramics, and plastics. Containers made of these materials are thus usable for containing food. Various types of dishes are currently available in the marketplace and are adequate for the uses to which these items are required. One drawback to these types of dishes is that the materials from which they are made do not normally retain heat and nothing but the internal latent heat of the food exists to maintain the proper food temperature. After the initial heating in a microwave oven, a relatively large thermal gradient exists between the heated food and the environment, including the container material. Therefore, upon removal of the heated food from the microwave, the heat quickly dissipates from the food and transfers to the ambient environment and to the container, thereby reducing food temperature to below acceptable levels.

Past attempts to counteract the tendency of the food in a container to quickly cool include the use of materials that are able to retain some heat energy after the container and food is removed from the microwave oven. These materials are capable of absorbing and retaining the microwave radiation energy and then reradiating or conducting the energy as heat from the heat retention material to the food or to the walls of the food container that are in contact with the food. Such materials have included, for example, quarried soapstone (McCarton et al.; U.S. Pat. No. 4,258,695), wet sand (Sepahpur; U.S. Pat. No. 4,567,877), silicone rubber with entrained ferrite particles (U.S. Pat. No. 5,107,087), earthenware with entrained small iron filings or particles (Ramirez; U.S. Pat. No. 7,176,426), etc. While these and other materials are adequate for retaining heat energy that can be transferred to the food, the materials may not be palatable, and may indeed be unsafe for human consumption. Thus, many of the known food containers enclose the heat absorbing material in a sealed portion of the food warming container, mainly to isolate the food from the heat retaining material as a safety feature, and also to maintain the heat retaining material in place for future reuse.

Johnson, U.S. Pat. No. 5,052,369 teaches a heat retaining food container having a cover and a bottom portion, each one of the cover and bottom portion including a heat storage system comprised of a non-metallic heat storing mass enclosed within a sealed chamber. The walls forming the chamber are formed from a polymeric material, such as hard plastic, which is transparent to microwave radiation, is also physically and chemically stable up to approximately 400° F., is chemically stable to detergents and other rinsing agents, and is resistant to staining and discoloration.

One disadvantage of the heat retaining containers that are hermetically sealed, for example, such as that taught by Johnson, is that neither the cover nor the bottom portion include a safety valve for escape of gases that may be generated by overpressure during excessive heating of the material in the container. Such temperatures may be far in excess of those to which the container and material would be exposed in normal usage, and may even exceed those that might occur through accidental overheating.

When the microwave absorbing material contents is overheated, that is, it is heated beyond the time or power level necessary to achieve optimum latent heat retention, the pressure in a sealed chamber may become excessive and must be accommodated by the structure of the chamber in which the heat retaining material is disposed. Accidental, and sometimes malicious, overheating in a microwave oven, a frequent event, thus normally causes the container to crack, rupture or become permanently deformed. On occasion, the deformation is catastrophic because the high pressures developed in the chamber are contained until such a high pressure is reached that renders the container wall material susceptible to rupture or explosive stress fracture, thereby relieving the overpressure, sometimes in a violently destructive manner.

To overcome the risk of loss of structural integrity, some devices have a very robust construction so as to be capable of withstanding high temperature and pressure levels. For example, Murdough et al., U.S. Pat. No. 3,734,077, and Lanigan et al., U.S. Pat. No. 3,837,330, both teach that the danger of bursting is avoided by reason of the configuration and construction of the device, which utilizes a secure interconnection between the upper and lower portions of the shell containing the heated material.

Many devices provide means to overcome the destructive capacity of overpressurization of the containers due to overheating by including some pressure relief mechanism. For example, Ramirez U.S. Pat. No. 7,176,426, relies on using a solid, rather than fluid, heat retention material and also on minimizing the volume of air within the chamber by sealing the chamber at high temperatures so as to cause a semi vacuum, i.e., negative pressure. Because the volume of fluid material susceptible to expansion upon heating is minimized, gas within the chamber does not cause excessive pressures when overheated to a reasonable level. Others, for example, Wyatt, U.S. Pat. No. 6,005,233 and U.S. Pat. No. 6,188,053, teach an elaborate and complicated pressure relief system using one or more types of check valves that vent excess pressure built up within the heat storage chamber to the environment. These types of complicated and expensive devices, such as dish carriers (with their corresponding covers), thermos bottles or containers having elaborate check valve systems, are not readily suitable for use in restaurants, hospitals or homes.

All of the above described methods for accommodating the overpressure caused by overheating of the microwave absorbing material suffer from one or more problems, including, in some cases, the destructive, that is, irreversible, nature of the pressure relief, or the devices themselves are so complicated that both the construction and manufacturing method for making them becomes cumbersome and/or overly expensive. Alternatively, some devices rely on physical principles or robust construction, with the hope that the person heating the microwave absorbing material will not exceed expected parameters. This hope is not always borne out in reality.

While the present invention is described at least partially as a process of heating by microwaves, use of other methods of heating are also possible, for example, induction heating of foods. See, for example, U.S. Pat. No. 7,183,525 to Fuchs and U.S. Pat. No. 7,038,179 to Kim et al. While this invention relies as a best mode of heating that includes use of a microwave oven, it is conceivable that other types of indirect, quick heating may be used and or developed in the future. Thus, the source of heat provided in this invention should be understood to include any form of heating that quickly and efficiently heats up a heat absorbing material, as described below.

None of the prior art methods known heretofore teach an easy to manufacture, flexible device that can accommodate internal overpressure by opening a relief valve at the moment that the walls of the chamber begin to deform, and which exact pressure and temperature combination does not depend on preselected parameters, but depends directly on the individual characteristics of the particular device that is being heated. What is needed is a non-destructive, overpressure mechanism for use in a chamber holding thermal energy or microwave absorbing materials, that will relieve the pressure only when the structure defining the chamber begins the deformation process, and as a result of the structural characteristics and materials comprising the walls of the chamber, the chamber can return to its previous state to eliminate such deformation once the materials have cooled and the internal pressure has been reduced.

SUMMARY OF THE INVENTION

Accordingly, there is provided a food service heat retaining device comprising an enclosure member having a preselected shape, including two opposed portions, a top portion and bottom portion, attached to each other to form a chamber that is sealed at the edges of each portion during the manufacturing process, a heat retention material within the sealed chamber, said heat retention material being capable of being heated by thermal or microwave radiation and of retaining heat in a latent state for at least a preselected time, an aperture in at least one of the opposed portions of said enclosure member and a pressure relief mechanism disposed in the aperture that seals the aperture from the ambient environment external to the sealed chamber when the enclosure member is in a normal condition, wherein at least one of the top and bottom portions of said enclosure member are deformable when the heat retention material has been abnormally or excessively heated by thermal or microwave radiation so as to cause excessive temperature or pressure to deform at least one of said portions and cause the pressure relief mechanism to open a fluid communication path through said aperture, thereby to permit excess pressure within the enclosure member to be relieved to the ambient environment.

In the discussion below, when describing the walls of the container as being rigid or semi-rigid, it should be understood that the walls are essentially rigid when the temperature and pressure within the container are at normal operating levels. The rigidity factor of the walls of the container may be a function of the temperature and/or pressure. One main feature of the invention is that the walls are deformable upon abnormal conditions that may develop through accidental misuse of the container, as is explained below. Additionally, while the invention is described as being used in the preferred method by heating with microwave energy, other types of energy are also considered to be capable of providing the same effects.

The invention is a container, semi-rigid in form when utilized in a normal manner. The container has walls made of a material that is transparent to microwaves or other thermal energy that is emitted through the walls of the container. The walls of the container can be come flexible and deform, as described below, to provide a means for pressure relief. Thus, it should be understood that when described as being rigid or semi-rigid, the walls of the container may become flexible when the contents of the container are under excessive heat and/or pressure. Additionally, for purposes of this description, while microwave energy is described as the preferred form of energy that is imparted to the material contained in the container, other forms of thermal energy are intended to be encompassed by the description, for example, induction heating energy. Thus, where these terms are set forth in the description, they also should be understood to also refer to the alternative forms.

The inventive container has a semi-rigid rigid hollow base or bottom portion that is joined to a top portion to provide a sealed cavity enclosing a microwave or other thermal energy absorbing and heat retaining material. The material may be one of those described as being known in the prior art above, or it may be specially developed for use with the present invention. Ideally, the heat retention material is not in contact with the food and may be in minimum physical contact with the internal walls defining the rigid container. The rigid container and the microwave and absorbing, heat retaining material may have different predetermined shapes, volumes and masses, according to the desired intended use of the heat retention device, but generally the outer shape of the container may take the form of generally recognized tableware, such as plates, bowls, trays, saucers, mugs, cups, etc. The inventive heat retention device can be used individually as an additional element that can be brought adjacent the tableware to which heat needs to be applied, if a solid, or it may be integrated into the structure of the dishes, bowls, trays, coffee mugs, etc., especially if a liquid or gel is used as the heat retention material.

In another aspect the invention is a method of manufacture of a food service heat retaining device comprising: providing a top and bottom portion, each portion having corresponding peripheral edges around the periphery of a central heat retention material container, providing a pressure relief mechanism in one of the top or bottom portions, the pressure relief mechanism being biased to a closed position when the pressure and temperature parameters of the device are in a normal condition of use, and being forced into an open condition when there is an overpressure condition, inserting the pressure relief mechanism into an aperture in one of the top or bottom portions so as to plug said aperture, connecting the pressure relief mechanism to at least one of the top and bottom portions, bringing the portions toward each other so that the peripheral edges come into contact with each other and connecting the peripheral edges to each other to create a sealed chamber between the top and bottom portions.

In another aspect, the invention comprises a method of manufacture of the device that is relatively inexpensive, and utilizes frictional heat of two plastic surfaces that are vibrated against each other to produce the joining of the bottom and top portions without use of any chemical adhesives or glue that avoids contamination of food stuffs during use of the device. It has been found that a heat retention device made in accordance with the inventive method is capable of withstanding high temperatures and pressures while maintaining its integrity and sealing properties. This has removed the need present in some prior art devices which have required central welding of the portions of the devices to each other, and has also made for a robust construction that can be easily manufactured.

The present invention will now be discussed in further detail below with reference to the accompanying figures as described briefly below.

DETAILED DESCRIPTION OF THE PREFERRED EMBODIMENTS

Figure 1:
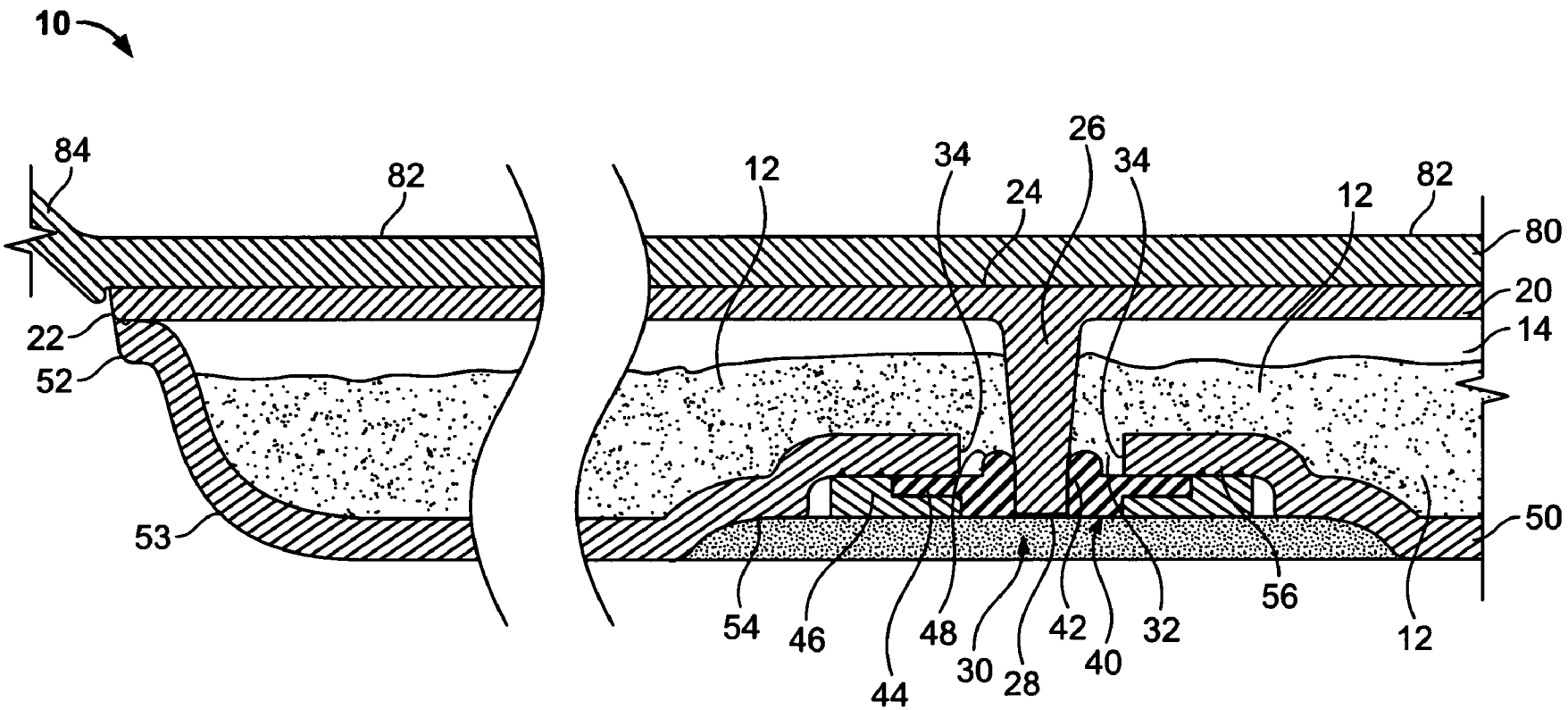
FIG. 1 is a first, preferred embodiment, in a cross-sectional cutaway view, showing a microwaveable heat retention device according the present invention.

Referring now to FIG. 1, a first, preferred embodiment of the heat storage device 10 is shown. The device 10 comprises two main structural elements, a top portion 20 and a bottom portion 50, each shown in broken cross-section. The top and bottom portions 20, 50 are ideally bonded together to form a sealed container or vessel for containing a heat retention material 12 within a chamber 14 defined by the heat retention device. The bottom portion 50 includes a bottom surface element 51, a peripheral edge 52 and side wall(s) 53, and provides for a centrally impressed hollow 54.

The top portion 20 further comprises a peripheral edge 22 provided for bonding the top portion to the bottom portion 50, a food serving surface 24 and a centrally located post 26 having a protruding end 28 that extends essentially perpendicularly from the body of top portion 22 and toward the bottom portion 50. The post interacts with elements of the bottom portion 50 to provide a pressure relief mechanism 30, as will be explained below. As shown in FIG. 1, a second food serving element 80, having a food serving surface 82, and optionally, an upturned flange 84 that provides for an upwardly concave depression for containing food and liquid sauces, etc.

The second food serving element 80 is attached to the surface 24 of the top portion 20, and is in close contact therewith in order to conduct the heat from the heat retention material 12 to the surface 82 of the second food serving element or tray 80. The second food serving element 80 includes upwardly turned sides 84 that contain the food and possible fluid food stuffs, for example soups or sauce, within the concave bowl shaped member that surrounds the food serving surface 82. The second food serving element 80 preferably is adjacent to and in close contact with the surface 24 of the top portion 20, so as to provide good heat transfer form the material 12 in chamber 14 to the food that is being served. While it is contemplated that the materials comprising the device 10 and the second food serving element 80 may be identical, for example, a hard plastic, i.e., melamine resin or melamine formaldehyde, other materials may also be used for each of the elements. The surface 82 or the element 20 may comprise a material having high heat conductivity, for example, a metal, or other, composite material that is transparent to microwaves. As another alternative, it is possible to include a metal only in a detachable food container 80 to provide for the higher heat conductivity, so that the metal does not disturb the operation of the microwave.

Another alternative to the integral construction shown in FIG. 1 is that the two parts may be separable for purposes of reuse. It is not necessary that the food containing part, that is, the second food serving element 80 need be permanently attached to the heat retention device 10, but it may be detachable for purposes of cleaning, for example, in a dishwasher. A mechanism, for example, clamps (not shown) may be used to attach the second food serving element 80 to the surface 24, which after the user is done, can detach the element 80 from the device 10, to enable the cleaning of only the surface that had come into contact with the food. The heat retention device 10 may then be attached to the same or to another food containing element, such as the element 80 shown, and so enable the reuse of the heat retention by microwaving the material 12 therein with newly served food in a clean second food serving element 80. Of course, the materials comprising the elements 20, 80 can also be robust and capable of withstanding the expected abuse that is normally encountered in the process of cleaning the dishes, for example, in a dishwasher.

The outer diameter edges, for example, top edge 22 and bottom edge 52 are attached to each other around the complete periphery of the device so as to seal the chamber 14 from the ambient environment in a leak-proof seal when the container is used in normal conditions. The method of attachment is not critical to the structural aspects of this device, and is more germane to the method of making the device 10, as will be described in greater detail below. For example, the seal may include an adhesive, or one or more additional structural elements (not shown) which create the necessary seal. However, the preferred method of attaching the edges 22, 52 of the top and bottom portions 20, 50 is by vibration or ultrasonic welding of the edges after they have been brought into contact with each other. Ideally, the welding process produces a seal having sufficient strength that it can remain integral upon exertion of normal pressure build-up within the chamber 14, whether through overheating or any other cause.

Significantly, the seal provided must be able to withstand extremes of internal pressure that may develop upon heating of the heat retaining material 12 contained in the chamber 14. However, in the event of an accidental, or otherwise, overheating of the material 12, a pressure relief mechanism 30 is provided in the device 10 in the form of a centrally disposed vent aperture or opening 32 defined by sides 34 of the bottom portion 50. The pressure relief mechanism 30 may be frangible, where the breaking of the seal during a pressure relief operation is irreversible, or may be a seal that will reform in the event that the pressure returns to normal.

The opening 32 is preferably circular and is sealed by an elastic ring plug 40 that covers the aperture 32 in an elastic manner. The use of an elastic material for the ring plug 40 is not an absolute requirement, but is preferred as an expedient manufacturing technique to forgive tolerance differences and also to permit the preferred manufacturing process, as will be explained below. Moreover, although the shape of the device is preferably cylindrical, and the shape of the apertures are also circular for easy manufacturing, it is possible that the device may take any of a number of shapes, such as square, rectangular, octagonal, ovoid and other shapes, and will work equally as well.

The aperture 32 is disposed in centrally impressed hollow 54 of the bottom portion 50 which is dimensioned to fit aperture 32 in an indent removed from the plane at which the device will contact a flat surface, such as a table (not shown). The use of a hollow 54 permits resting of the device 10 on such a flat horizontal surface, while still leaving enough clearance for the operation of the pressure relief mechanism 30. Additional protection from accidental damage to the pressure relief mechanism 30 is provided by a second indent 56, within the hollow 54, which accommodates the elements of the pressure relief mechanism 30 and partially encloses them.

As shown in FIG. 1, the post 26 of the top portion 20 extends toward the pressure relief mechanism 30 and into the aperture 32 defined by the sides 34. To provide a fairly good seal in the aperture 32, there is provided the elastic ring plug 40, having a central throughhole 42. A flanged section 44 of the ring plug 40 is formed to seal against the bottom of the wall forming the indent 56 and the sides of throughhole 42 will simultaneously also seal against the post 26 adjacent the end 28. In order to maintain the seal against the wall of bottom portion 50, a flanged retainer 46 may be used to capture the flanged section 44 and compress it against the wall. To enable a better seal, or to better calibrate the extent to which deformation must occur before opening of a fluid communication path, tubular extensions 48 may be disposed in the internal terminal of the throughhole 42 causing the end 28 of post 26 to travel a greater extent, thus requiring an extra measure of deformation of the walls before activating the venting capability of the pressure relief mechanism 30.

The flexibility of plastic material comprising the walls of the top and bottom portions 20, 50 can provide a predetermined amount of tolerance in the device 10 in response to material expansion and the increased pressure of gas within the device, thereby causing the walls to move apart to a slight extent. This separation of the walls will be most pronounced at central locations by virtue of the peripheral connection of the top and bottom portions 20, 50 at their respective edges. However, the design of the device includes some tolerance to permit a slight wall separation, but not so great a separation that it will open the vent provided by the pressure relief mechanism 30. That is, when threshold values of temperature and pressure are reached, the deformation to the plastic walls will be such as to withdraw the end 28 of the post 26 from the throughhole 42 causing the pressure to be relieved and the walls to again come toward each other to recreate the seal. Of course, and under normal use conditions, it is highly desired to have the heat retention device 10 to perform with no physical deformation, the pressure relief only being activated when there is a severe overheating of the material 12.

The heat retention material 12 may be any type of known heat retention material, such as those described above, but in the preferred embodiment, is a fluid, a liquid or a viscous material, such as a gel, under normal ambient temperatures and pressures. It is noted that all matter, including the heat retention material 12, changes volume when heated, usually expanding with increasing temperature. To accommodate the expansion, a small pocket or gap for air or other gas is allowed within the chamber defined by the walls of the device, which gas is compressible and thus can absorb a slight expansion of the material 12. It is contemplated that the lack of an air pocket, in other words, the material 12 completely fills the chamber 14, would exert a greater pressure on the walls and seams bonding the top and bottom portions 20, 50 to each other until there is a failure in the seal between them. Even if that were not to occur the first time that the device overheated, the continued cycling between heated and cooled material 12 would eventually force a crack or other opening in the surface of the walls of the device 10.

In a preferred embodiment, the material 12 is a gel made to precise specifications for the particular use with this invention. Ideally, the material 12 has properties that include easy microwavability without damage to the material 12, an ability to quickly absorb heat from microwaves, and also the ability to retain latent heat absorbed by the material for a predetermined period of time so it can maintain the heat and apply it to the associated chamber and container walls. Since at least one of the walls is in contact with the food stuffs, the food will be kept warm for the duration desired by the user. Moreover, the material 12 cannot be toxic, for if there is a release of the material in an overpressurization event, then the escape of gases that had been in contact with the material that are vented to the ambient environment, for example, the inside of a microwave oven, do not cause irreparable damage. That is, even if the material is not safely consumable, the user may still be able to wipe off the inside of the microwave oven and be able to safely reuse it after an escape of gas form the inside of the chamber 14.

Figure 2:
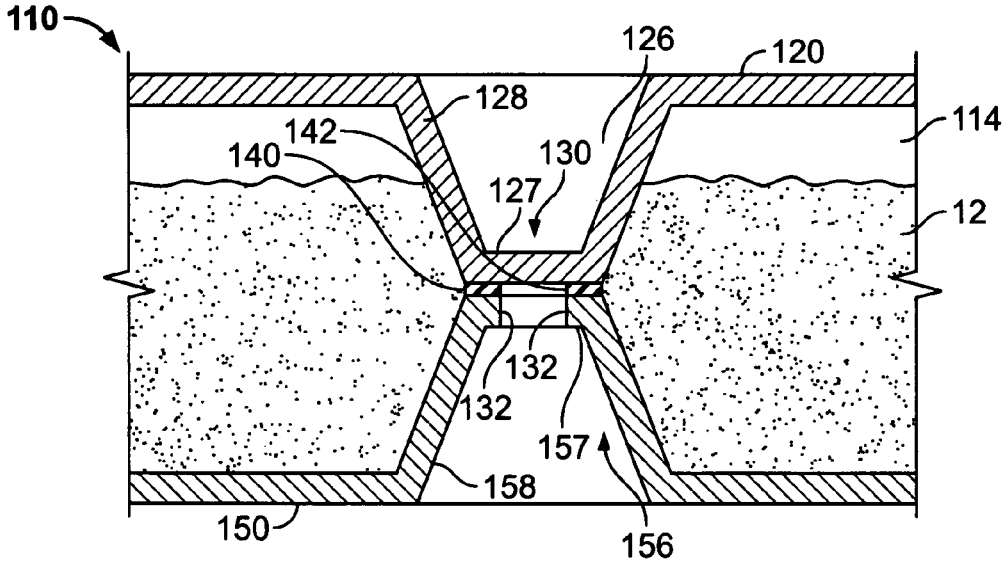
FIG. 2 is a detail cross-sectional view of another embodiment showing an alternative pressure relief mechanism according to the present invention.

Referring now to FIG. 2, a second embodiment of the inventive device is shown and identified by numeral 110. For purposes of discussion of this and the following embodiments, identical identification numerals will be used for identical elements, and where elements having similar characteristics or functions, the similar numeral, but having a different hundred place number (i.e., the initial digit) will be used. For example, the material 12 in the embodiment of FIG. 2 is the same, so it has the same identification numeral, but the pressure relief mechanism 130 is different, hence it is designated by the numeral 130, rather than 30 as in the FIG. 1 embodiment. Moreover, because the remainder of the alternative devices 110 etc., will be essentially identical, for example in the peripheral connection of the top and bottom portions, the illustrated figures will only show the details of the central portion of each embodiment, including the pressure relief mechanisms, for example, pressure relief mechanism 130.

A similar aperture 132 for venting the overpressure that may arise in the chamber 114 of a second embodiment of the device 110 includes in each of the walls of the top portion 120 and the bottom portion 150 an inwardly concave depression 126, 156, respectively, formed by angled or frustoconical wall sections 128, 158, teach terminating in a horizontally extending terminal wall 127, 157, respectively. The aperture 132 is disposed preferably in the bottom portion terminal wall 157.

By virtue of the device construction, the top and bottom portions 120, 150 each cause the respective terminal walls 127, 157 to be biased inwardly toward the other terminal wall, so as to cause at least a section of the terminal walls 127, 157 to engage and contact each other, thereby forming a seal to inhibit fluid communication between the chamber 114 and the ambient environment. To ensure that a tight seal is formed, an elastic ring 140 may be disposed between the terminal walls or may be attached to the contacting sections of the terminal wall 127. Although shown in cross-section as an ring to include a throughhole 142, the elastic seal may take any shape, including a plug that is attached to the bottom of terminal wall 127, so that if overpressure develops in the chamber 114 that forces the top and bottom portions 120, 150 apart, and the terminal walls separate, a fluid communication path is opened to vent the chamber 114 to the ambient environment, for example into the inwardly concave depression 156. After the overpressure condition is relieved, and the device 110 cools naturally by dissipation of the excess heat, the walls are constructed to once again revert to their previous state, bringing the terminal walls 127, 157 toward each other to reform the seal resulting from engagement of the terminal walls.

Figure 3:
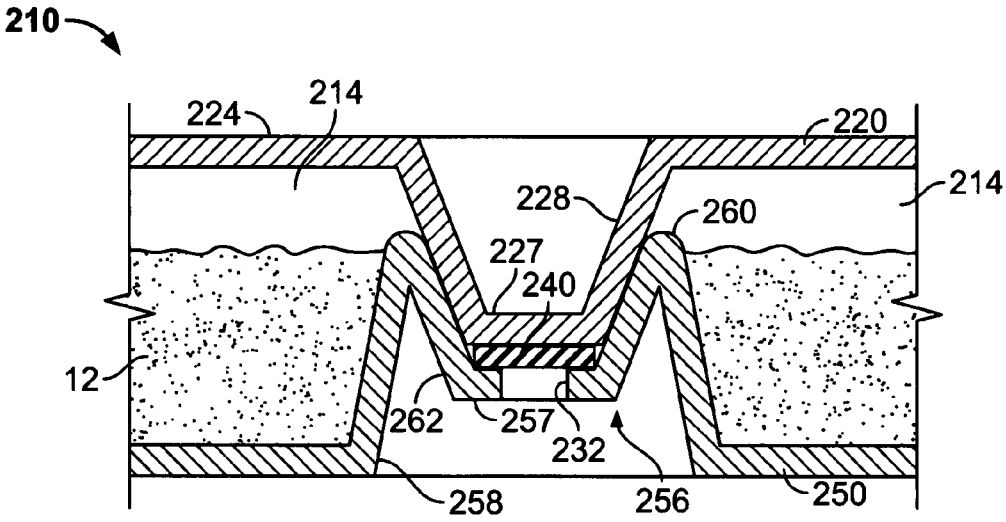
FIG. 3 is a detail cross-sectional view of yet another embodiment of the present invention showing an alternative pressure relief mechanism.

Referring now to FIG. 3, another embodiment of the inventive device is shown and identified by numeral 210. It is in many respects similar to the embodiment of device 110 of FIG. 2, including the frustoconical wall 227 and a pressure relief mechanism 230 including the aperture 232. One significant difference from the second embodiment is the angled walls 258 do not meet the terminal wall 227 of the top portion 220 directly, but angle upwardly toward the surface 224 before angling back to extend from a sharp corner 260 along a second frustoconical wall 262 to end at the terminal wall 257. The benefits of this construction are two-fold, and include the greater contact area between second frustoconical wall 262 and the wall 228. In addition, the height of the corner 260 is preselected to be higher than the expected height of the heat retention material 12, when the device 210 is in a normal horizontal position, as shown. Thus, when the top and bottom portions, 220, 250 move apart under an overpressure condition, only gas from the gap 214, and not fluid from the material 12, will be vented to the ambient environment.

Another difference is the elastic plug 240 between the terminal walls 227, 257 has no throughhole, as in the previous two embodiments. Preferably, the plug is in the shape of a disc 240 that is attached to the bottom of terminal wall 227. In this constriction, separation of the terminal walls 227, 257 caused by overpressure will permit venting of the gas in chamber 214 through the fluid communication gap that will open between walls 228 and 262, past the disc 240 and through the aperture 232 to the ambient environment immediately adjacent comprising the depression 256.

Figure 4:
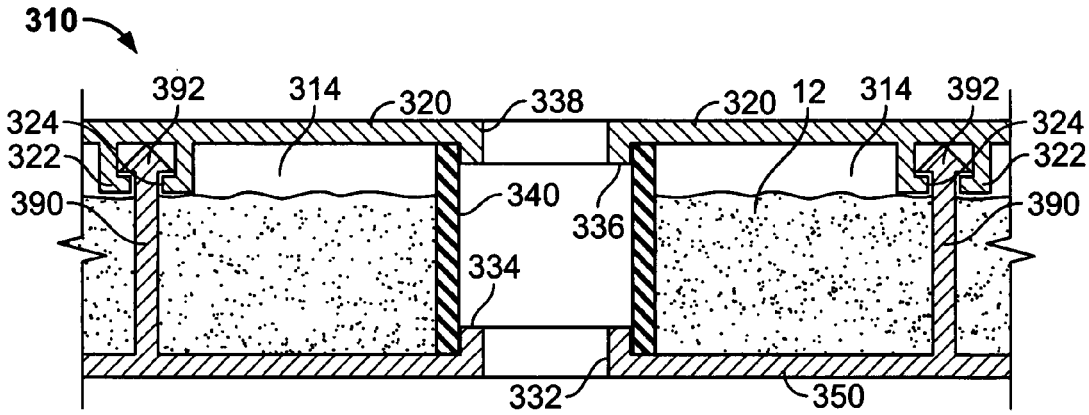
FIG. 4 is a detail cross-sectional view of still another embodiment showing an alternative pressure relief mechanism according to the present invention.

Referring now to FIG. 4, yet another embodiment of the inventive device is shown and identified by numeral 310. It comprises a top portion 320 and a bottom portion 350. One significant difference from the previous embodiments is that the top portion 320 includes an aperture 338 that is a mirror image of the aperture 332 that is centrally disposed in bottom portion 350. Each of the portions 320 and 350 include an inwardly extending and overhanging lip, a lip 336 around the aperture 338 and a bottom lip 334 around the aperture 332. Lips 334, 336 face each other and define a gap between them that is plugged by an elastic tubular member 340 extending from inside lip 334 to inside lip 336 The tubular member 340 is sized and dimensioned to seal off the gap by engaging the inside walls of the lips 334, 336. Although the tubular member may be connected to one or the other of the lips 334, 336, such connection is not necessary as the elastic tension of the tubular member may retain the tubular member in place.

In the event of an overpressure event, the top and bottom portions 320, 350 will be forced to separate from each other, and so cause one or another of the seals at the lips 334 or 336 to open a fluid communication path to the ambient environment. Because of the cantilevered construction with the lips, and to avoid venting of the chamber 314 by accidental opening of the seal provided by the elastic tubular member, it may be advisable to include optional posts 390 that connect the top to the bottom portions 320, 350 and extend at discrete points from the central apertures 332, 338 to retain the two portions in the desired distance from each other. The posts 390 may have a laterally extending, cantilevered member 392 that will enable the cantilevered portion 392 to snap fit and attach within a receiving enclosure 322 by inserting the cantilevered member 392 into an aperture 324 of the top portion 320 until it locks in place, as shown.

Of course, proper lateral placement of the posts 390 within the chamber 314 is essential if the overpressure is to be relieved early in the process. That is, the posts 390 should be far enough away from the aperture 332, 338 to permit some flexibility in the walls of top and bottom portions 320, 350, but not so much flexibility as to break the seal between the elastic tubular member 340 and the lips 334, 336 during normal use. Another feature provided by this construction, in which a middle portion of the elastic tubular member 340 is unsupported by the rigid walls of the top and bottom portions 320, 350, is that will allow the tubular member 340 to itself deform slightly in response to an overpressure condition and open a fluid path to relieve the overpressure to the ambient environment.

Figure 5:
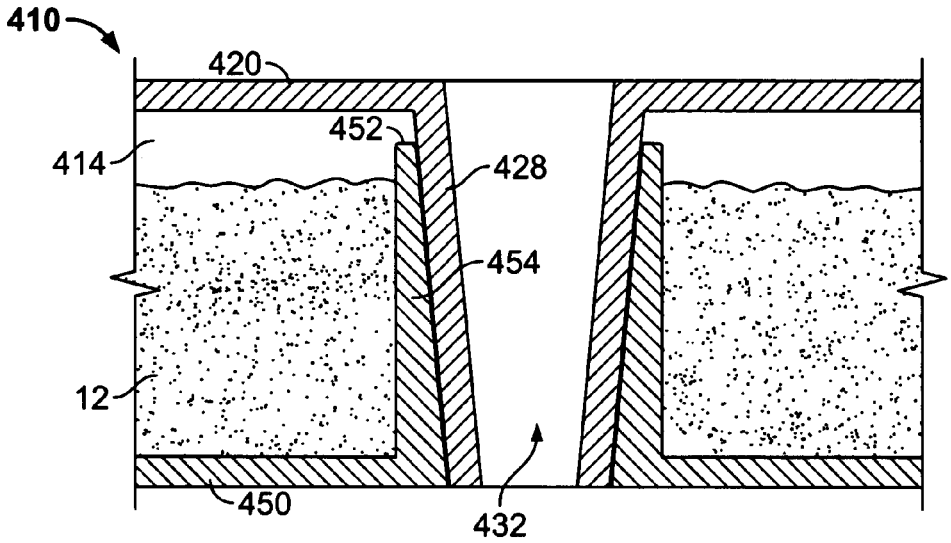
FIG. 5 is a detail cross-sectional view of yet another embodiment of the present invention showing an alternative pressure relief mechanism.

Referring now to FIG. 5, yet another embodiment of the inventive device is shown and identified by numeral 410. It is in many respects similar to the embodiment of device 310 of FIG. 4, but includes an angled frustoconical wall 428 connected to the top portion 420 as a pressure relief mechanism 430, including an aperture 432.

The bottom portion 450 includes a flanged side wall 454 that extends from the bottom portion 450 to a terminal point 452 that is adjacent the oppositely facing top portion 420. Preferably, the height of the terminal point 452 is preselected to be higher than the expected height of the heat retention material 12, when the device 410 is in a normal horizontal position, as shown. Thus, when the top and bottom portions, 420, 450 move apart under an overpressure condition, only gas from the gap 414, and not fluid from the material 12, will be vented to the ambient environment.

One significant difference of the embodiment of FIG. 4 is the absence of an elastic plug providing a seal, which is present in the other embodiments. Because the walls 428, 454 of the two engaging sections are angled, they form a tight interference fit between the frustoconical surfaces so as to minimize communication of the gas in chamber 414 to the ambient environment in the air hole 432.

Figure 6A:
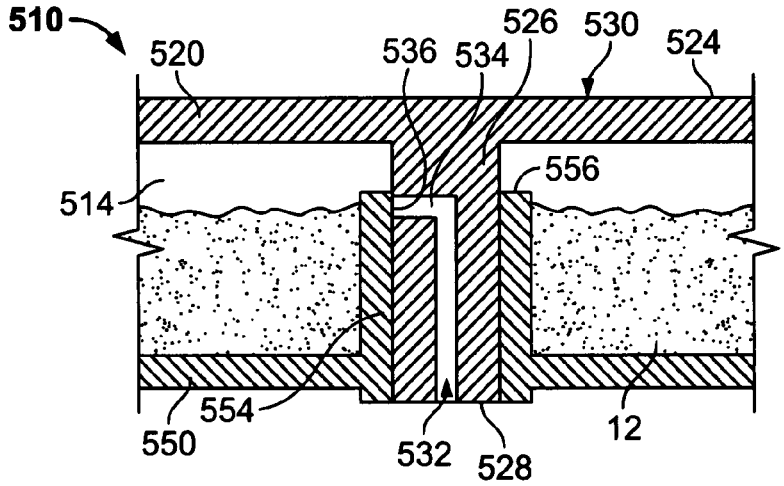
FIGS. 6A and 6B illustrate in a detail cross-sectional view another embodiment of the present invention showing an alternative pressure relief mechanism and the process for venting the chamber when it is in an overpressure condition.
Figure 6B:
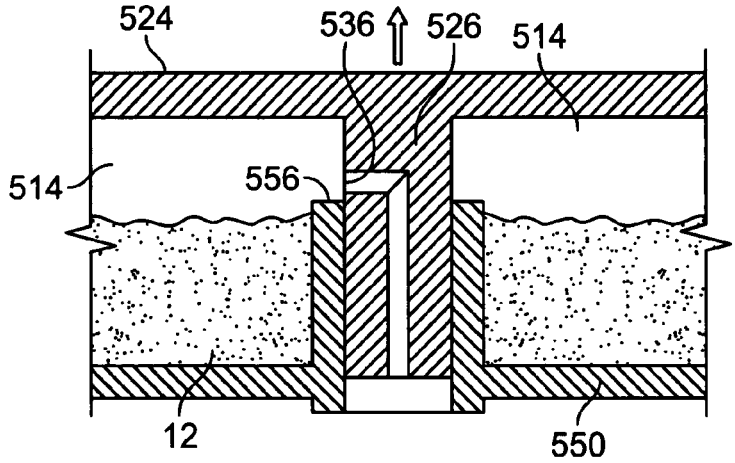

Referring now to FIGS. 6A and 6B, still another embodiment of the inventive device is shown and identified by numeral 510. FIG. 6A shows the device 510 in a normal condition and FIG. 6B shows the device 510 in an overpressure condition, during which the pressure is being relieved by venting the chamber 514. As seen in FIG. 6B, top portion 520 has been forced to move in the direction of the arrow away from bottom portion 550.

The structural configuration of the device 510 is in many respects similar to the embodiment of device 10 of FIG. 1. The bottom portion 550 has a tubular conduit 554 that extends from the bottom portion 550 toward the top portion 520 for a length that is preselected to be higher than the expected height of the heat retention material 12, when the device 510 is in a normal horizontal position, as shown. The length of the tubular conduit 554 should ideally provide a vertical end 556 that extends to a position between the expected height of the heat retention material 12 and the inner surface of the top portion 520. It is important to leave a sufficient amount of clearance to permit the operation of the pressure relief mechanism 530 as will be explained below.

Device 510 further has a centrally disposed post 526, including a longitudinal orifice 532 extending through the center of the post 526, which extends from the top portion 520 toward the bottom portion 550 and in normal assembly is inserted in to the tubular conduit 554. The orifice 532 opens out of a distal end 528 of the post 526, that is, from an end that is open to the environment, and has a perpendicular turn to a shorter end 534 extending from the center of post 526 laterally toward the surface of the post ending at a vent outlet hole 536.

When the device 510 is in a normal condition, as shown in FIG. 6A, the vent hole remains within the tubular conduit 554 which inhibits venting or egress of any material or gas from chamber 514 through the orifice 532 to the ambient environment. However, when the material 12 has been overheated, which produces the overpressure conditions by which the device begins to deform, the top and bottom portions 520, 550 begin to separate at the central area shown by the arrow, which causes the post 526 to be withdrawn from the tubular conduit 555 until the vent outlet hole 536 clears the top end 556. As the vent outlet hole clears the top end 556, the pressure within the chamber 514 is relieved by outgassing of the air or gas in the chamber that is above the heat retention material 12. Thus, when the top and bottom portions, 520, 550 move apart under an overpressure condition, as shown by the arrow in FIG. 6B, the material is below the top 556 of the conduit 554 and so only gas from the gap 514, and not fluid from the material 12, will be vented to the ambient environment. The central location of the post in this, as well as the other embodiments, also assists in the proper operation of the device 10, 110, etc., in that the post is less likely to bind in one or another direction if the structure is symmetrical.

Figure 7:
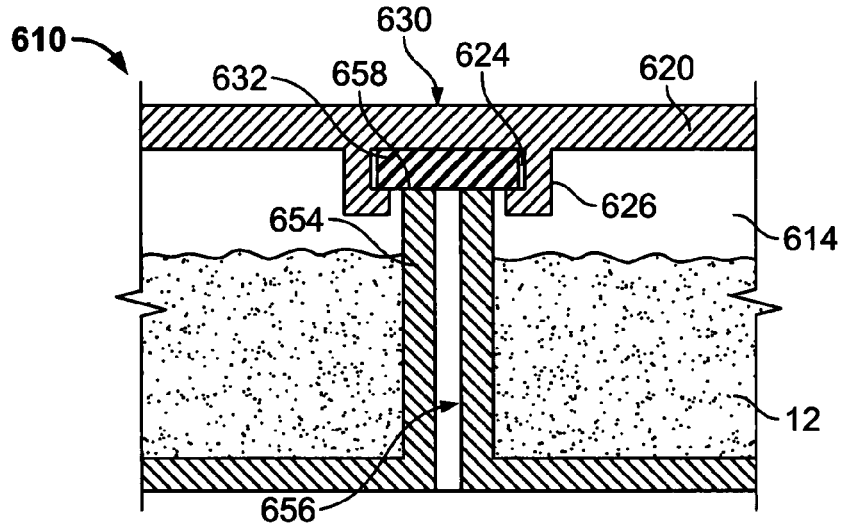
FIG. 7 is a detail cross-sectional view of still another embodiment of the present invention showing an alternative pressure relief mechanism.

Referring now to FIG. 7, another alternative configuration of a device 610 having a pressure relief mechanism 630 is shown. The bottom portion 620 includes a tubular conduit 654 that extends from the bottom portion 620 most of the way to the top portion 650. A central orifice 656 within the conduit 654 terminates at an upper end 658. The length of the tubular conduit 654 is preselected to extend above the expected level of the heat retention material 12, as shown.

The top portion 620 includes a recess 624 that is provided by protruding walls 626, and the dimensions and location of which are preselected to receive a disc 632 made of an elastomeric material having good sealing properties. The disc is shaped and dimensioned to engage the upper end 658 of the tubular conduit 654 and as the device 610 is constructed so as to bias the top portion 620 toward the bottom portion 650, the upper end 658 will be pressed into and seal against the disc 632. If there is an overpressure condition in the device 610, then the top and bottom portions 620, 650 will be forced slightly apart as the walls of the device 610 begin to deform, causing the seal to be broken and the gas in the gap of chamber 614 to be vented to the ambient environment.

The strength of the walls predicates the valve operation pressure, thus the valve activates only when it is needed. Sufficient flexibility is provided by the structure and materials of the device that cause the deformation of the walls of the top and/or bottom portions to open the pressure relief valve. For example, the rigidity of the container walls can be varied by the wall thickness and by providing one or more rib structures and other geometric arrangements the function of which is to guide the flexibility of the device. It may be desirable to increase the rigidity of the structure so as to allow greater pressure to build up within the chamber, which in turn allows more thermal energy to be absorbed before the valve operates. This may be especially desirable when an increase in temperature or the latent heat capability of the device is desired so as to prolong the heat retention duration.

Another significant feature and significant advantage of the present invention is the method of manufacture thereof. Specifically, the two main portions 20, 50; 120, 150; etc., of the specific embodiment 10, 110, etc., respectively, of the invention are first formed by an appropriate method, for example, blow molding, injection molding, etc., so as to form the configuration desired for one of the embodiments described above, or its equivalent. To simplify the following description, the preferred manufacturing methods will be described in relation to the embodiment 10 of FIG. 1, it being understood that the description is equally applicable to the other embodiments, with appropriate modifications as necessary.

The two portions 20, 50 are preferably formed from a hard plastic material that maintains its shape under pressure and tension experienced by a device according to the present invention, and which is also permeable to microwaves. The side walls 53 of the bottom portion 50 are made in accordance with a preselected height, so that the depth of the bottom portion 50, that is the distance between the top of edge 52 to the bottom of the surface 51 is uniform or is defined to accommodate the corresponding height of the pin or post 26 of the top portion 20.

Referring again to FIG. 1, the device has a premolded plastic weld plug assembly including the flanged retainer 46 and elastic ring 40. As shown, the flange section 44 of ring 40 fits within a recess 48 of the flanged retainer 46 to form the unitary premolded plug assembly. The flanged retainer 46 and elastic ring 40 can be bonded to each other, but a unitary co-molded part is preferred where the height of the flanged section 44 is slightly wider than the height of the recess 48.

In the next step of the manufacturing process, the plastic weld plug assembly is attached within the impressed the central impressed hollow 54 so as to cover the aperture 32. Ideally, the sides 34 of aperture 32 are concentric with the central throughhole 42 so that the throughhole 42 becomes centrally located with reference to the peripheral edges 52 of the bottom portion 50. The top of flanged retainer 46 is connected to the second indent 56 of the bottom portion 50. While any appropriate method may be used, it is preferable that a benign connection be made. For example, vibration welding the top of flanged retainer 46 to the underside of the second indent 56, taking care that the flange section 44 of the elastic ring 40 is between the second indent and the recess 48 ensures that a fluid seal is provided therebetween. This construction also provides for the throughhole 42 to be the only fluid communication through the bottom portion 50.

At this point, a temporary plug may be inserted into the throughhole 42 and a heat retention material 12 is inserted in the bottom portion 50. If heat retention material 12 comprises a fluid, the bottom surface 51 and side walls 53 contain the fluid, and the temporary plug (not shown) does not permit the material from flowing out through the throughhole 42. Of course, if the material 12 is a solid or semi-solid at room temperature, no temporary plug may be needed. As shown in FIG. 1, the heat retention material 12 is a gel, which may be inserted in the bottom section 50 at this time.

The top section 20 is then brought down and the end 28 of the post 26 is inserted into the throughhole 42 to seal the throughhole 42, simultaneously pushing out the temporary plug, which may then be reused in the manufacture of the next device 10. The elastic ring throughhole 42 preferably is slightly smaller in diameter than the post 26, thereby creating a compression seal to be formed between them.

The edges 22, 52 of the two portions are then brought together until they are engaged around the complete periphery of the portions 20, 50, and the edges are then attached together to create a complete seal to the chamber 14. The preferred method of attaching the edges 22, 52 of the top and bottom portions 20, 50 is by vibration or ultrasonic welding of the edges after they have been brought into contact with each other. Vibration welding is a process by which the edges of the top and bottom portions are pressed together and then subjected to vibration at a high frequency so that the friction of the edges in contact and rubbing against each other causes the plastic material to melt locally and weld to each other. This operation uses high frequency, low displacement vibration, which permits the positioning of the parts relative to each other to be more precise. Ideally, the welding process produces a seal having sufficient strength that it can remain integral upon exertion of normal pressure build-up within the chamber 14, whether through overheating or any other cause.

The vertical position or height of the portions is precisely known and repeatable. When the edges 22, 52 are brought together, the end 28 of the post 26 preferably extends through and just outside of the aperture 32 clearing the sides 34 of the aperture 32, but not so far as to protrude beyond the plane of the bottom surface 51. Thus, the device can be placed on a table or other surface without mishap to the seal. The vibration weld process results in a slightly random final horizontal positioning of the top and bottom portions 20, 50, but the tolerances can be reduced to within +/−0.030 inches (+/−1.0 mm) of axial alignment. Here, the design of the elastic weld plug ring 40 provides a secondary feature of this invention in that the slight variance in the horizontal imprecise positioning of the post 26 relative to the throughhole 42 can be accommodated. The elastic characteristics of the ring 40 permit the use of the vibration welding as a connection operation because the elastic can vibrate with the vibration of the flanged retainer 46 without causing the ring to adhere or otherwise bond to the post 26.

The safety features of the plug assembly is provided by a combination of elements that are each associated to the walls of both the top and bottom portions 20, 50 of device 10. The seal is optimally placed in the center of the device 10, so that it is centrally located and is susceptible to the greatest amount of deflection in the event of an overpressure event. This location will provide the initial and greatest outward deflection when internal pressure builds up within chamber 14. If internal pressure is created, the flat walls will move away from each other and withdraw the end of the post 26, thereby opening the plug to expel fluid from within the chamber 14, thereby reducing the pressure therein. The fluid expelled will depend upon the position of the external fluid opening that provides communication from the chamber 14. It is, of course, desirable that the expulsion of the internal contents will prevent the rupture of the primary vibration weld joint at the edges 22, 52, or the secondary plug sonic weld joint between the flanged connector 46 and the second indent 56. The design described also allows a greater amount of fluid pressure to escape with greater deformation of the device 10. The rigidity of the device 10 walls dictate the operating pressure of the plug assembly, and when the pressure relief mechanism will open, therefore it is reasonable to strengthen the materials and structure of the walls to provide maximum performance.

The preferred embodiment for simplifying the manufacturing process may utilize a temporary plug (not shown) providing the holding capacity of the fluid used as the heat retention material 12. However, if necessary, an additional fill aperture, not shown, may be disposed in the wall of the upper portion 20 so as to permit more fluid heat retention material 12 to be inserted into the chamber 14.

The invention herein has been described and illustrated with reference to the embodiments of FIGS. 1-7, but it should be understood that the features and method of making and of use of the invention is susceptible to substitution, change, modification, or alteration without departing significantly from the spirit of the invention. For example, the dimensions, size and shape of the various elements may be altered to fit specific applications. Similarly, the use of different materials may permit variations in the structure. Since other modifications and changes may be varied to fit particular operating requirements and environments will be apparent to those skilled in the art, the invention is not considered limited to the embodiments chosen for purposes of disclosure. Other additional features may be included, for example, a holding chamber or other collection area to receive any expelled gas or thermal retention material so as to prevent the requirement of excessive clean up by the consumer in the event of an overpressure accident. Other features may include a valve having an alert that overpressure conditions are encountered. For example, the valve may be formed in the shape of a whistle, much like a teapot, so that as the pressure approaches a predetermined level, the device emits a sound or other indicator to alert the consumer to shut off the microwave or other heat or thermal energy imparting element.

Accordingly, it is intended that this invention include all changes and modifications which do not constitute departures from the true spirit and scope of this invention. Accordingly, the specific embodiments illustrated and described herein are for illustrative purposes only and the invention is not limited except by the following claims.

What is claimed is:

1. A heat retaining device comprising:

(a) an enclosure member having a preselected shape, including a top portion and bottom portion attached to each other to form a sealed chamber;

(b) a heat retention material within said sealed chamber, said heat retention material being capable of being heated by thermal energy radiation and of retaining heat in a latent state for at least a preselected time;

(c) an aperture in at least one of the top or bottom portions of said enclosure member; and (d) a pressure relief mechanism disposed in the aperture that seals the aperture from the ambient environment external to the sealed chamber when the enclosure member is in a normal condition, wherein at least one of the top and bottom portions of said enclosure member are deformable when the heat retention material has been abnormally and excessively heated by thermal energy radiation so as to cause excessive pressure to deform at least one of said portions of said enclosure member, said deformation causing the pressure relief mechanism to open a fluid communication path through said aperture, thereby to permit excess pressure built up within the enclosure member to be relieved to the ambient environment through said pressure relief mechanism; and wherein at least one of said deformed portions of said enclosure member returns to its normal condition when the pressure is reduced.

2. A heat retaining device according to claim 1 wherein said heat retention material is a gel.

3. A heat retaining device according to claim 1 wherein said heat retention material comprises clay with entrained small iron particles.

4. A heat retaining device according to claim 1 wherein said pressure relief mechanism further comprises a ring sealed against at least one of said top or bottom portions and a post attached to an opposing at least one of said top or bottom portions, wherein the post extends through a through hole in the ring so as to form a seal, the seal closing fluid communication from said sealed chamber to the ambient environment through said aperture, unless abnormally excessive pressure has deformed one or both portions.

5. A heat retaining device according to claim 4 wherein said post has an internal tubular conduit that provides for the fluid communication path upon deformation of at least one of the portions.

6. A heat retaining device according to claim 4 wherein said post has an internal tubular conduit that is sealed by an elastomeric member disposed within the sealed chamber.

7. A heat retaining device according to claim 1 wherein said enclosure includes a centrally disposed through hole that extends from the top portion to the bottom portion.

8. A heat retaining device according to claim 7 wherein said pressure relief mechanism includes an elastic tubular member extending from the top portion to the bottom portion.

9. A heat retaining device according to claim 1 wherein said pressure relief mechanism includes an elastic disc attached to one of the top portion or the bottom portion and sealing against a surface on the other of the top portion or the bottom portion.

10. A heat retaining device according to claim 1 wherein the preselected shape of the enclosure includes rib structures within the walls of the top or bottom portions.

11. A heat retaining device comprising:

(a) an enclosure member having a preselected shape, including a first portion and an opposing second portion attached to each other to form a chamber;

(b) a heat retention material within said chamber, said heat retention material being capable of being heated by thermal energy radiation and of retaining heat in a latent state for at least a preselected time;

(c) an aperture in at least one of the first or second portions of said enclosure member; and (d) a pressure relief mechanism disposed in the aperture that seals the aperture from the ambient environment external to the chamber when the enclosure member is in a normal condition, wherein at least one of the first and second portions of said enclosure member are deformable when the heat retention material has been abnormally and excessively heated by thermal energy radiation so as to cause excessive pressure to deform at least one of said portions of said enclosure member, said deformation causing the pressure relief mechanism to open a fluid communication path through said aperture, thereby to permit excess pressure built up within the enclosure member to be relieved to the ambient environment through said pressure relief mechanism; and wherein at least one of said deformed portions of said enclosure member returns to its normal condition when the pressure is reduced.

* * * * *